US006481977B2

(12) United States Patent
Mameda et al.

(10) Patent No.: US 6,481,977 B2
(45) Date of Patent: Nov. 19, 2002

(54) SWASHPLATE TYPE VARIABLE-DISPLACEMENT COMPRESSOR

(75) Inventors: Yasuo Mameda, Tochigi (JP); Masaki Kawachi, Tochigi (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/778,756

(22) Filed: Feb. 8, 2001

(65) Prior Publication Data

US 2001/0016168 A1 Aug. 23, 2001

(30) Foreign Application Priority Data

Feb. 18, 2000 (JP) ..... 2000-040907
Feb. 18, 2000 (JP) ..... 2000-040918

(51) Int. Cl.[7] ..... F04B 1/26

(52) U.S. Cl. ..... 417/222.2; 417/270; 417/295; 417/298

(58) Field of Search ..... 417/222.2, 270, 417/295, 298

(56) References Cited

U.S. PATENT DOCUMENTS 5,603,610 A * 2/1997 Kawaguchi et al. ..... 417/295
5,785,502 A * 7/1998 Ota et al. ..... 417/222.2
6,045,337 A * 4/2000 Tokumasu ..... 417/222.2
6,142,745 A * 11/2000 Kawaguchi et al. ..... 417/222.2

FOREIGN PATENT DOCUMENTS

JP 6-89741 11/1994
JP 2001-90657 * 4/2001

* cited by examiner

*Primary Examiner*—Cheryl J. Tyler
*Assistant Examiner*—Michael K. Gray
(74) *Attorney, Agent, or Firm*—Foley & Lardner

(57) ABSTRACT

A swashplate type variable-displacement compressor includes a compressor housing defining therein a crank chamber, a refrigerant suction chamber, a refrigerant discharge chamber, and a low-pressure refrigerant passage connected to an evaporator outlet, and a pressure regulator. The pressure regulator controls the amount of low-pressure refrigerant gas flowing into the refrigerant suction chamber by regulating a differential pressure between the pressure in the refrigerant suction chamber and the pressure in the crank chamber. The pressure regulator is comprised of a flow control valve including a first spring-loaded, normally-closed spool valve and a pressure chamber accumulating the working pressure used to force the spool valve toward its fully-opened position, and a flow control valve actuating mechanism including a communication passage through which the refrigerant discharge chamber is communicated with the pressure chamber, a second spring-loaded, normally-closed pilot valve provided in the communication passage, and an electromagnetic solenoid controlling the opening of the pilot valve so that the opening increases with an increase in exciting current supplied to the solenoid. The pilot valve serves to introduce high-pressure refrigerant gas in the refrigerant discharge chamber into the pressure chamber as the working pressure with the opening controlled by the solenoid.

15 Claims, 9 Drawing Sheets

SWASHPLATE TYPE VARIABLE-DISPLACEMENT COMPRESSOR

TECHNICAL FIELD

The present invention relates to a swashplate type variable-displacement compressor, and particularly to a swashplate type variable-displacement compressor serving as a compression part of a refrigerator circuit such as an automotive air-conditioning system, so as to compress refrigerant vapor to a relatively high pressure.

BACKGROUND ART

In recent years, there have been proposed and developed various swashplate type variable-displacement compressors in which a valve opening of a pilot valve is controlled depending on a current value of exciting current for an electromagnetic solenoid, in order to act high-pressure refrigerant gas introduced from a refrigerant discharge chamber via the pilot valve having the controlled opening on the back of a piston-shaped spool valve portion for adjustment of axial position of the piston-shaped spool valve portion, and consequently to control the amount of low-pressure refrigerant gas flowing into a refrigerant suction chamber. One such swashplate type variable-displacement compressor has been disclosed in Japanese Patent Second Publication No. 6-89741. The swashplate type variable-displacement compressor disclosed in the Japanese Patent Second Publication No. 6-89741, is basically constructed as a typical swashplate type variable-displacement compressor equipped with a compressor clutch which is a solenoid-type electromagnetic clutch located in a compressor pulley. The clutch equipped swashplate type variable-displacement compressor is complicated in structure. Generally, the clutch equipped swashplate type variable-displacement compressor is comparatively heavy in weight, and also requires many component parts. In addition to the above, when the amount of low-pressure refrigerant gas flowing from the evaporator outlet into the refrigerant suction chamber of the compressor must be adjusted to "0" to prevent icing of the evaporator core during operation of the swashplate type compressor with the compressor clutch engaged, the magnitude of exciting current of the electromagnetic solenoid which is used to actuate the pilot valve is generally controlled to the maximum so as to move the piston-shaped spool valve portion to a fully-closed position corresponding to the maximum length of the piston-shaped spool valve stroke, thus resulting in increased electric power consumption.

SUMMARY OF THE INVENTION

Accordingly, it is an object of the invention to provide a swashplate type variable-displacement compressor, which avoids the aforementioned disadvantages.

It is another object of the invention to provide a lightweight, clutchless swashplate type variable-displacement compressor, which is capable of being switched between operative (ON) and inoperative (OFF) states without using a compressor clutch, and of controlling evaporator icing by demagnetizing an electromagnetic solenoid used to operate a pilot valve (capable of controlling the flow of refrigerant from the evaporator outlet to a refrigerant suction chamber of the compressor) for the purpose of adjustment of the amount of low-pressure refrigerant gas flowing into the refrigerant suction chamber to "0".

In order to accomplish the aforementioned and other objects of the present invention, a swashplate type variable-displacement compressor comprises a compressor housing which defines therein a crank chamber, a refrigerant suction chamber, a refrigerant discharge chamber, and a low-pressure refrigerant passage connected to an evaporator outlet, a pressure regulator which controls an amount of refrigerant gas flowing into the refrigerant suction chamber by regulating a differential pressure between a pressure in the refrigerant suction chamber and a pressure in the crank chamber, the pressure regulator comprising a flow control valve including a first spring-loaded, normally-closed valve, a return spring permanently biasing the first valve to a fully-closed position, a spring chamber operably accommodating therein the return spring, and a pressure chamber accumulating a working pressure used to force the first valve toward a fully-opened position, the flow control valve provided in the low-pressure refrigerant passage upstream of the refrigerant suction chamber, and a flow control valve actuating mechanism including a communication passage through which the refrigerant discharge chamber communicates with the pressure chamber, a second spring-loaded, normally-closed valve provided in the communication passage, a return spring permanently biasing the second valve to a fully-closed position, and an electromagnetic solenoid controlling an opening of the second valve so that the opening increases with an increase in exciting current supplied to the solenoid, the second valve serving to introduce high-pressure refrigerant gas in the refrigerant discharge chamber into the pressure chamber as the working pressure with the opening controlled by the solenoid.

According to another aspect of the invention, a swashplate type variable-displacement compressor comprising a compressor housing which defines therein a crank chamber, a refrigerant suction chamber, a refrigerant discharge chamber, and a low-pressure refrigerant passage connected to an evaporator outlet, a pressure regulator which controls an amount of refrigerant gas flowing into the refrigerant suction chamber by regulating a differential pressure between a pressure in the refrigerant suction chamber and a pressure in the crank chamber, the pressure regulator comprising a flow control valve including a spring-loaded, normally-closed spool valve, a return spring permanently biasing the spool valve to a fully-closed position, a spring chamber operably accommodating therein the return spring, and a pressure chamber accumulating a working pressure used to force the first valve toward a fully-opened position, the flow control valve provided in the low-pressure refrigerant passage upstream of the refrigerant suction chamber, and a flow control valve actuating mechanism including a communication passage through which the refrigerant discharge chamber communicates with the pressure chamber, a second spring-loaded, normally-closed pilot valve provided in the communication passage, a return spring permanently biasing the pilot valve to a fully-closed position, and an electromagnetic solenoid controlling an opening of the pilot valve so that the opening increases with an increase in exciting current supplied to the solenoid, the pilot valve serving to introduce high-pressure refrigerant gas in the refrigerant discharge chamber into the pressure chamber as the working pressure with the opening controlled by the solenoid, and the flow control valve including a pressure regulating passage which escapes or channels the working pressure in the pressure chamber into the refrigerant suction chamber, and a flow-constriction means which serves to generally fully close the pressure regulating passage when the spool valve is held at the fully-opened position. It is preferable that the pressure regulating passage may comprise a communication passage through which the spring chamber of the flow control valve communicates with the refrigerant suction chamber, and a flow-constriction passage formed in the spool valve to intercommunicate the pressure chamber and the spring chamber. More preferably, the variable-displacement compressor may further comprise a stopper provided in the spring chamber to limit the fully-opened position of the spool valve and to close an opening end of the flow-constriction passage facing the spring chamber by abutment between the spool valve and an end face of the stopper when the spool valve is held at the fully-opened position. Also, the flow-constriction means may comprise a flow-constriction orifice groove formed on at least one of the end face of the stopper and the opening end of the flow-constriction passage facing the spring chamber to provide a flow-constriction orifice having a predetermined orifice size smaller than a flow-constriction passage area of the flow-constriction passage under a condition in which the fully-opened position of the spool valve is limited by abutment between the spool valve and the end face of the stopper. Preferably, the spool valve has a spool groove, and a pressure-receiving surface area of one side wall of the spool groove is dimensioned to be equal to a pressure-receiving surface area of the other side wall of the spool groove. It is preferable that the flow control valve actuating mechanism may further comprise a feedback means which detects a change in pressure in the evaporator outlet side of the low-pressure refrigerant passage upstream of the flow control valve to shift the pilot valve to either of a valve opening direction and a valve closing direction depending on the pressure change detected when the pressure change in the evaporator outlet side of the low-pressure refrigerant passage exceeds a predetermined allowable pressure change under a condition that the pilot valve is held at a given opening, so that an opening of the flow control valve is controlled and thus the pressure in the evaporator outlet side is kept constant. The flow control valve actuating mechanism may further comprise a pressure regulating passage through which the crank chamber communicates with the evaporator outlet side of the low-pressure refrigerant passage upstream of the flow control valve.

According to a still further aspect of the invention, a swashplate type variable-displacement compressor comprises a compressor housing which defines therein a crank chamber, a refrigerant suction chamber, a refrigerant discharge chamber, and a low-pressure refrigerant passage connected to an evaporator outlet, a pressure regulator which controls an amount of refrigerant gas flowing into the refrigerant suction chamber by regulating a differential pressure between a pressure in the refrigerant suction chamber and a pressure in the crank chamber, the pressure regulator comprising a flow control valve including a spring-loaded, normally-closed spool valve, a return spring permanently biasing the spool valve to a fully-closed position, a spring chamber operably accommodating therein the return spring, and a pressure chamber accumulating a working pressure used to force the first valve toward a fully-opened position, the flow control valve provided in the low-pressure refrigerant passage upstream of the refrigerant suction chamber, and a flow control valve actuating mechanism including a communication passage through which the refrigerant discharge chamber communicates with the pressure chamber, a second spring-loaded, normally-closed pilot valve provided in the communication passage, a return spring permanently biasing the pilot valve to a fully-closed position, and an electromagnetic solenoid controlling an opening of the pilot valve so that the opening increases with an increase in exciting current supplied to the solenoid, the pilot valve serving to introduce high-pressure refrigerant gas in the refrigerant discharge chamber into the pressure chamber as the working pressure with the opening controlled by the solenoid, and the flow control valve including a pressure regulating passage which channels the working pressure in the pressure chamber into the refrigerant suction chamber, and a fluid-flow passage shutoff means which serves to fully close the pressure regulating passage when the spool valve is held at the fully-closed position. Additionally, the fluid-flow passage shutoff means serves to fully close the pressure regulating passage even when the spool valve is held at the fully-opened position. It is preferable that the pressure regulating passage may comprise a communication passage formed in the housing accommodating therein the spool valve to communicate the pressure chamber with the refrigerant suction chamber there via, a recessed portion formed on an outer periphery of the spool valve which is communicatable with an opening end of the communication passage facing the pressure chamber depending on an axial position of the spool valve, and an orifice passage formed in the spool valve to communicate the recessed portion with the pressure chamber there via, and the recessed portion is formed on the outer periphery of the spool valve so that the recessed portion is brought into fluid-communication with the opening end of the communication passage facing the pressure chamber only when the spool valve is held within a predetermined valve opening range of the spool valve except for both the fully-closed position and the fully-opened position, so as to form the fluid-flow passage shutoff means by the spool valve itself. More preferably, the pressure regulating passage may comprise a communication passage through which the spring chamber of the flow control valve communicates with the refrigerant suction chamber, and a flow-constriction passage formed in the spool valve to intercommunicate the pressure chamber and the spring chamber. Preferably, the fluid-flow passage shutoff means may comprise a differential pressure valve provided in the flow-constriction passage to fully close the flow-constriction passage in response to a differential pressure between the pressure chamber and the spring chamber when the spool valve is held at the fully-closed position, and a stopper provided in the spring chamber to limit the fully-opened position of the spool valve and to close an opening end of the flow-constriction passage facing the spring chamber by abutment between the spool valve and an end face of the stopper when the spool valve is held at the fully-opened position. Alternatively, the flow-constriction passage may comprise a communication passage provided in the spool valve to intercommunicate the pressure chamber and the spring chamber, and a bushing fitted to one opening end of the communication passage and having an orifice passage.

The other objects and features of this invention will become understood from the following description with reference to the accompanying drawings.

DESCRIPTION OF THE PREFERRED EMBODIMENTS

Figure 1:
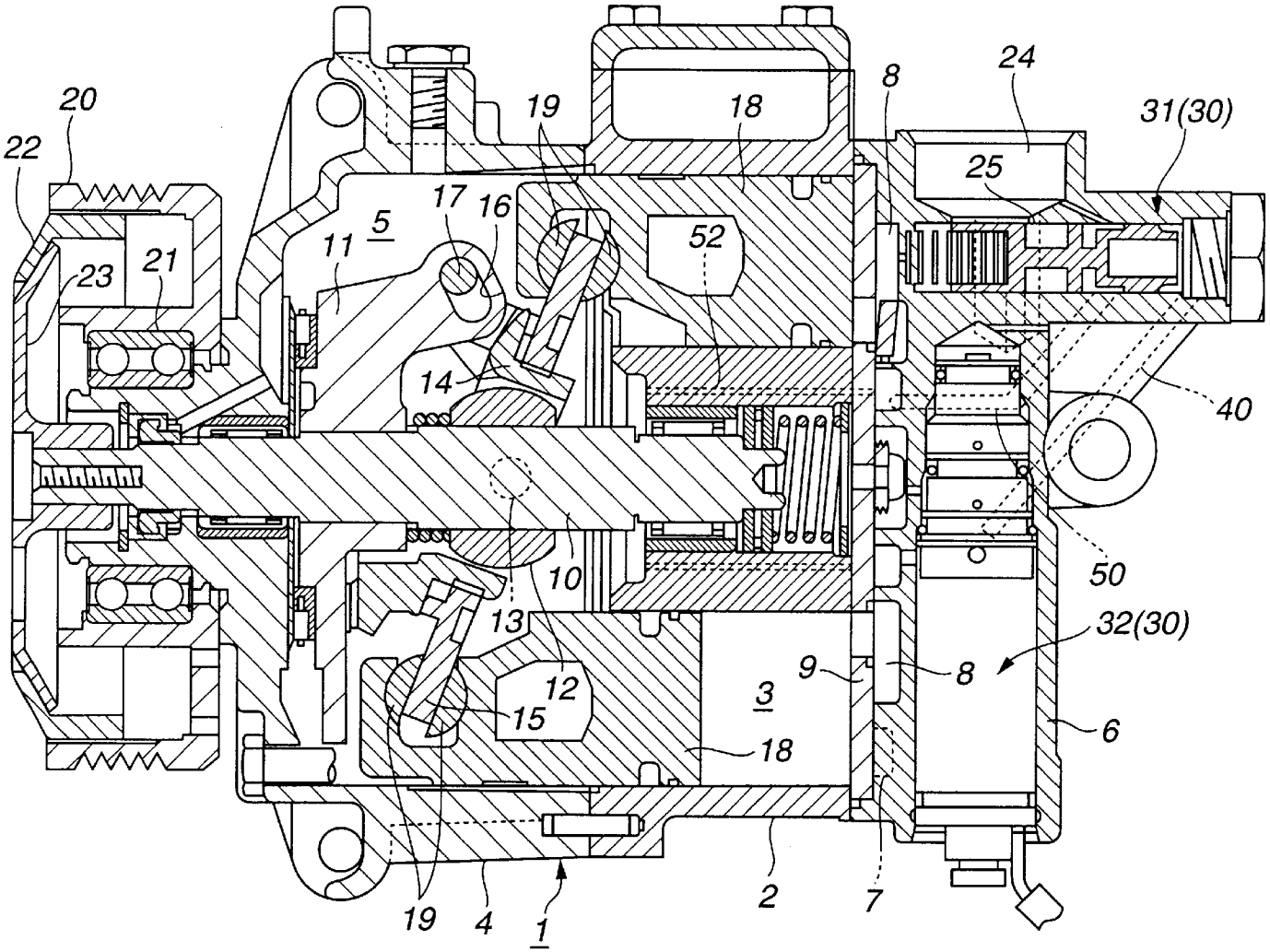
FIG. 1 is a longitudinal cross-sectional view showing one embodiment of a swash plate type variable-displacement compressor of the invention.
Figure 2:
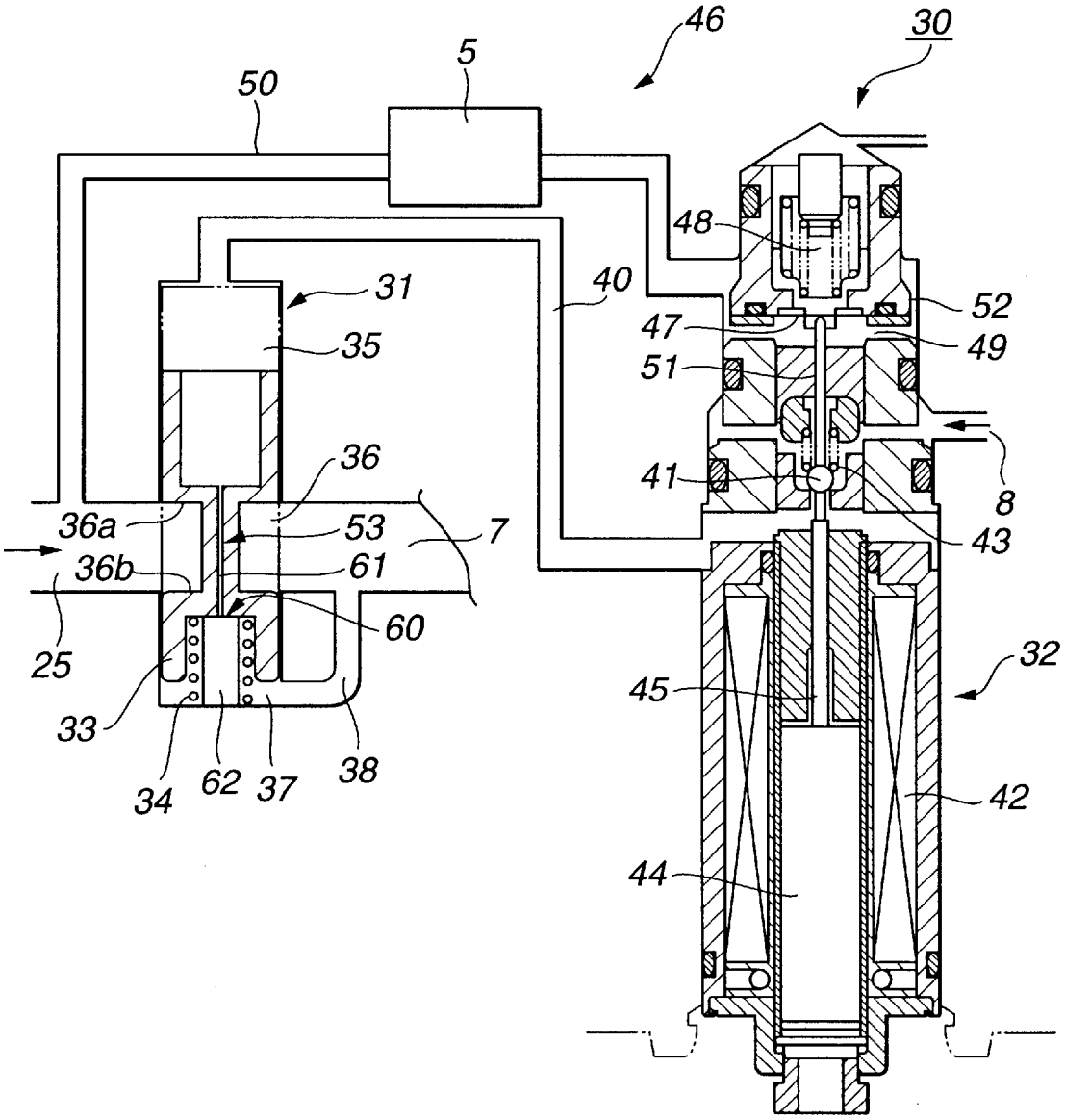
FIG. 2 is a cross-sectional view systematically showing a first embodiment of a pressure regulator means incorporated in the variable-displacement compressor shown in FIG. 1, with a flow-control spool valve kept in its fully-opened state.

Referring now to the drawings, particularly to FIG. 1, there is shown a swashplate type variable-displacement compressor suitable for an automotive air conditioning system. In FIG. 1, a compressor housing or a compressor crankcase 1 of the variable-displacement compressor of the embodiment is comprised of a cylinder block 2 formed with a plurality of cylinder bores 3, a front housing 4 located in front of the cylinder block 2 to define a crank chamber 5 in conjunction with the cylinder block 2, and a rear housing 6 located in rear of the cylinder block 2 via a valve plate 9 to define both a refrigerant suction chamber 7 and a refrigerant discharge chamber 8. Three parts, namely a drive plate 11, a journal 14, and a swash plate or a wobble plate 15 are provided in the crank chamber 5. The drive plate 11 is fixedly connected to a drive shaft or a compressor shaft 10. By means of a pin 13, the journal 14 is rockably connected to a sleeve 12 which is rockably fitted onto the drive shaft 10. The swash plate 15 is threadably connected onto the outer periphery of the journal 14. The journal 14 is mechanically linked to the drive plate 11 by way of a substantially circular-arc shaped slotted cam 16 and pin connection of a pin 17 which is loosely fitted into the cam slot 16, in such a manner as to allow the movement of the journal 14 with limits based on the cam slot 16. A plurality of pistons 18 are reciprocatingly accommodated in the respective cylinder bores 3. Each of the pistons 18 fits around the swash plate 15 through a pair of shoes (19, 19) each of which is substantially hemispherical in shape. A compressor pulley 20 is rotatably supported on one end (the left-hand end as viewed from FIG. 1) of the drive shaft 10 through a radial ball bearing 21. A first driving-torque transmission plate 22 is threadably connected onto the inner periphery of the pulley 21, while a second driving-torque transmission plate 23 is fixedly connected to the leftmost shaft end of the drive shaft 10. To provide a torque limiter, the first and second driving-torque transmission plates 22 and 23 are connected to each other in a manner so as to permit the second driving-torque transmission plate 23 to slip or slide with respect to the first driving-torque transmission plate 22, in case of application of excessive driving torque exceeding a predetermined driving-torque limiting value. As is generally known, the swashplate type compressor can vary the piston displacement or the length of piston stroke according to the amount of low-pressure refrigerant needed. The length of the piston stroke can be adjusted by varying the inclination angle of the swash plate 15. Hereinbelow described in detail, the inclination angle of the swash plate 15 can be changed while the compressor is running. The greater the angle of the swash plate 15, the farther the pistons 18 move. in their cylinder bores 3. As can be appreciated from the cross section shown in FIG. 1, the increased angle of the swash plate 15 increases the length of the piston stroke, so that the piston pumps more refrigerant gas. Conversely, as the inclination angle of the swash plate 15 is reduced, the length of the piston stroke also reduces, and thus each piston stroke pumps less refrigerant gas. In this manner, the compressor can be continuously run while only pumping the required amount of refrigerant gas. The swash-plate inclination angle can be controlled by means of a pressure regulator (or a pressure regulating means) 30. The pressure regulating means 30 is provided in the rear housing 6. Actually, the swash-plate inclination angle is controlled by the moment of a force about the pin 17 of the swash plate 15, which moment occurs owing to the differential pressure between the refrigerant-suction-chamber pressure and the crankcase pressure (the pressure in crank chamber 5). The differential pressure between the refrigerant-suction-chamber pressure and the crankcase pressure is controlled or regulated by the pressure regulating means 30. As shown in FIGS. 1 and 2, in the variable-displacement compressor of the embodiment, pressure regulating means 30 is comprised of a flow control valve 31, and a flow control valve actuating mechanism 32 which drives the flow control valve 31. Flow control valve 31 is provided in a low-pressure refrigerant passage 25 close to a refrigerant inlet 24 located upstream of the refrigerant suction chamber 7 and connected to an evaporator outlet (not shown), so as to directly control the flow of low-pressure refrigerant gas sucked into the refrigerant suction chamber 7.

Figure 3:
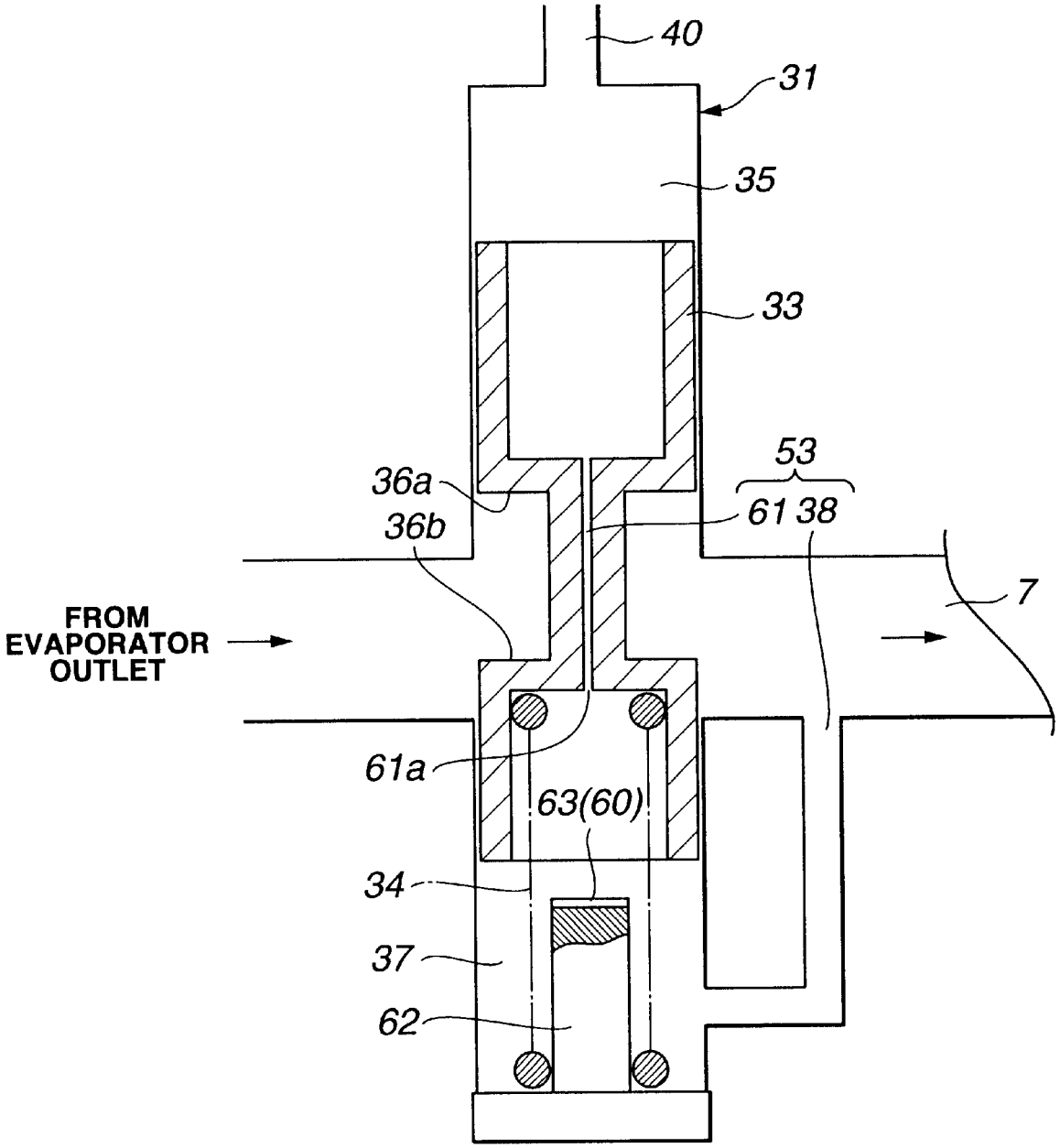
FIG. 3 is an enlarged cross-sectional view showing the detailed structure of a flow control valve of the pressure regulator means of the first embodiment shown in FIG. 2, with the flow-control spool valve partially opened.

For the sake of illustrative simplicity and for convenience, in FIG. 1 the flow control valve 31 is arranged perpendicularly to the axis of the flow control valve actuating mechanism 32, although the flow control valve 31 is actually arranged. parallel to the flow control valve actuating mechanism 32 so the compressor can be compactly designed. As shown in FIG. 1, the flow control valve 31 is comprised of a spool valve 33 whose axis is perpendicular to the low pressure refrigerant passage 25, a spring chamber 37 in which a return spring (or a spool valve spring) 34 is operably accommodated to permanently bias the spool valve 33 to a fully-closed position, and a pressure chamber 35 which accumulates a working pressure used to force the spool valve 33 toward a fully-opened position. As can be seen from the cross section of FIGS. 2 and 3, the spool valve 33 is constructed as a spring-loaded, normally-closed spool valve, and the pressure-receiving surface area of one side wall 36*a* of the spool groove 36 of the spool valve 33 is dimensioned to be equal to that of the other side wall 36*b*. The spring chamber 37, accommodating therein the spring 34, is communicated through a communication passage 38 with the refrigerant suction chamber 7 downstream of the flow control valve 31 provided in the low-pressure refrigerant passage 25. The flow control valve actuating mechanism 32 is provided in a communication passage 40 through which the refrigerant discharge chamber 8 and the pressure chamber 35 are communicated. The flow control valve actuating mechanism 32 is comprised of a ball valve 41 and an electromagnetic solenoid 42. The ball valve 41 serves as a pilot valve which controls the flow of refrigerant gas in the high-pressure side of refrigerant discharge chamber 8 introduced into the pressure chamber 35. As can be seen in FIG. 2, the pilot valve 41 is constructed as a spring-loaded, normally-closed ball valve. The pressure of refrigerant gas in the high-pressure side acts as a working pressure for the spool valve. The solenoid 42 functions to control the opening of the ball valve 41, responsively to the current value of exciting current used to energize the solenoid. The ball valve 41 is a spring-loaded, normally-closed valve which is kept on its valve seat by means of a return spring 43. When the solenoid 42 is energized, it forces an armature 44 upwards (viewing FIG. 2) to push a plunger 45 and consequently to control or adjust the opening of ball valve 41. Actually, the valve opening of the pilot valve 41 increases with an increase in exciting current supplied to the solenoid 42. For instance, when the current value of exciting current supplied to the solenoid becomes zero and thus the solenoid is de-energized, the valve opening becomes zero. Flow control valve actuating mechanism 32 is equipped with a feedback means 46. The feedback means 46 is designed to detect or sense the pressure (or the pressure change) in the evaporator outlet side of the low-pressure refrigerant passage 25 upstream of the flow control valve 31, so that the pressure in the evaporator outlet side is kept constant under a condition that the pilot valve 41 is held at a given opening substantially corresponding to the magnitude of exciting current supplied to the solenoid 42. As best seen in FIG. 2, the feedback means 46 is comprised of a diaphragm 47, a feedback passage 50, and a plunger 51. The diaphragm 47 separates an atmospheric chamber 48 from a refrigerant pressure chamber 49. The feedback passage 50 is provided to introduce the pressure at the evaporator side of the low-pressure refrigerant passage 25 into the refrigerant pressure chamber 49. The plunger 51 is supported by the central portion of the diaphragm 47. The plunger 51 is arranged coaxially with respect to the axis of the plunger 45 of the solenoid 42, so that the plungers 45 and 51 are opposed to each other. Actually, the feedback means 46 operates as follows. When an actual pressure change in the evaporator outlet side of low-pressure refrigerant passage 25 exceeds a predetermined allowable pressure change under a particular condition where the pilot valve 41 is controlled or held to a given opening substantially corresponding to the magnitude of exciting current supplied to the solenoid 42, the actual pressure change is sensed or detected by means of the diaphragm 47, and thus the pilot valve 41 is shifted to either of a valve opening direction and a valve closing direction by means of the plunger 51 depending on the pressure change detected, that is, a deviation from the predetermined allowable pressure change, so that the pressure in the evaporator outlet side of low-pressure refrigerant passage 25 can be kept constant and be brought into a desired pressure level by adjusting the opening of flow control valve 31. The aforementioned refrigerant pressure chamber 49 is communicated with the crank chamber 5 through a pressure regulating passage 52, so that the crank chamber 5 is communicated with the evaporator outlet side of the low-pressure refrigerant passage 25 upstream of the flow control valve 31. On the other hand, the flow control valve 31 includes a pressure regulating passage 53 and a flow-constriction means or a flow-constriction orifice means 60. Pressure regulating passage 53 relieves the pressure in the pressure chamber 35 and escapes the working pressure toward within the refrigerant suction chamber side of low-pressure refrigerant passage. 25. Flow-constriction means 60 serves to generally fully close the pressure regulating passage 53 when the spool valve 33 is fully opened. In the variable-displacement compressor of the embodiment, as shown in FIG. 3 the pressure regulating passage 53 is constructed by a flow-constriction passage 61 and a communication passage 38. The flow-constriction passage 61 is formed in the spool valve 33 and has a predetermined orifice, size or a predetermined flow-constriction passage cross-sectional area through which the pressure chamber 35 is communicated with the spring chamber 37. The communication passage 38 is provided to communicate the flow-constriction passage 61 and spring chamber 37 with;the refrigerant suction chamber side therethrough, so that the flow-constriction passage 61 and spring chamber 37 both open into the refrigerant suction chamber 7. A stopper 62 is provided in the spring chamber 37 so that the stopper limits a fully-opened position of the spool valve 33 by way of abutment between the lower end of the spool valve 33 and the upper end face of the stopper 62 at a position that the upper end face closes the opening end 61*a* of flow-constriction passage 61, facing the spring chamber.

Flow-constriction means 60 is constructed by forming a flow-constriction orifice groove 63 on the upper end face of the stopper 62. The groove 63 is dimensioned to provide a predetermined flow-constriction orifice size or a predetermined flow-constriction passage area smaller than that of the flow-constriction passage 61 under a particular condition in. which the fully-opened position of spool valve 33 is limited by abutment between the upper end face of stopper 62 and the lower end of spool valve 33. In the shown embodiment, although the groove 63 is provided at the upper end face of stopper 62, in lieu thereof the flow-constriction orifice groove 63 may be provided at a side of the opening end 61*a* of flow-constriction passage 61, or the groove 63 may be provided at both the side of the opening end 61*a* of flow-constriction passage 61 and the upper end face of stopper 62.

With the previously-described arrangement, the opening of the ball valve 41 is controlled depending on the current value of exciting current flowing through the solenoid 42, and thus the high-pressure refrigerant gas in refrigerant discharge chamber 8 is supplied through the ball valve 41 of the controlled opening into the communication passage 40, and then introduced into the pressure chamber 35 as a working pressure for spool valve 33. In response to the pressure in the pressure chamber 35, the spool valve 33 moves toward its fully-opened position against the bias of spring 34. The movement of spool valve 33 toward the fully-opened position tends to enlarge the fluid-flow passage area of low-pressure refrigerant passage 25 to properly control the flow of refrigerant gas flowing into the refrigerant suction chamber 7. Depending on the controlled flow of refrigerant gas the pressure difference between the pressure in refrigerant suction chamber 7 and the crank-chamber pressure can be adjusted, and thus the swash-plate inclination angle can be controlled. As a result of this, the length of the piston stroke can be varied so as to control the flow of refrigerant gas discharged. In this manner, the temperature control of the evaporator (not shown) can be achieved. Hereupon, as discussed above, the flow control valve 31 includes the pressure regulating passage 53 through which the pressure in the pressure chamber 35 can be relieved and channeled into the refrigerant suction chamber side of low-pressure refrigerant passage 25. Therefore, when the pilot valve (ball valve) 41 is closed by way of demagnetization of the electromagnetic solenoid 42 under a condition that the spool valve 33 is held at a given valve opening, the pressure regulating passage 53 serves to rapidly channel the working pressure in the pressure chamber 35 therethrough into the refrigerant suction chamber 7, thus ensuring a smooth valve closing operation for the spool valve 33 by virtue of the bias of spring 34. This enhances a response of the compressor serving as a power unit of the air conditioning system. As a whole, the refrigeration system response can be enhanced significantly. Additionally, according to the variable-displacement compressor of the embodiment, when the spool valve 33 is kept at the fully-opened position, the downstream opening end 61*a* of flow-constriction passage 61 (pressure regulating passage 53) is maintained at the generally fully-closed state by means of the flow-constriction means 60. Therefore, during high load of the variable-displacement compressor during which the spool valve 33 is held fully opened, there is no risk of leaking refrigerant gas under high temperature and high pressure, which gas can be introduced into the pressure chamber 35, via the pressure regulating passage 53 into the refrigerant suction chamber 7. This prevents a cooling performance of the refrigeration system from lowering during high compressor load with the spool valve 33 fully opened. Also, according to the variable-displacement compressor of the embodiment, the flow-constriction means 60 (flow-constriction orifice groove 63) allows a controlled channeling of refrigerant-gas pressure from the pressure chamber 35 even when the spool valve 33 is kept at its fully-opened state, thus insuring smooth sliding movement of the spool valve 33 from the fully-opened position to the valve closed position, occurring owing to demagnetization of the solenoid 42.

As set forth above, in the shown embodiment, the pressure regulating passage 53 is constructed by the flow-constriction passage 61 which is provided in the spool valve 33 itself, and the communication passage 38 through which the spring chamber 37 is opened into the refrigerant suction chamber 7 land which is used for balanced operation of the spool valve 33. In this case, the pressure regulating passage 53 can be provided by boring only the communication passage 38 in the rear housing 6. Thus, the number of machining processes for boring fluid passages in the housing can be reduced. This ensures a more simplified passage structure in the rear housing 6, and also increases the design flexibility of the rear housing 6. Furthermore, in the shown embodiment, the flow-constriction means 60 can be easily constructed by forming or machining the flow-constriction orifice groove 63 on the upper end face of the spool-valve fully-opened-position limiting stopper 62, thereby ensuring reduced machining processes for the rear housing 6, and thus reducing the production costs of the variable-displacement compressor or the total production costs of the automotive air conditioning system. Moreover, according to the variable-displacement compressor of the embodiment, in order to prevent an undesirable pressure drop in the evaporator side of low-pressure refrigerant passage 25 upstream of the flow control valve 31 by way of fluid-flow control of refrigerant flowing into the refrigerant suction chamber 7 for the purpose of preventing evaporator core icing when the refrigeration system is operating, the current value of exciting current flowing through the solenoid 42 is controlled to "0", and thus the solenoid is merely demagnetized. Owing to demagnetization of the solenoid, the ball valve (pilot valve) 41 is fully closed so as to stop the working-pressure supply to the pressure chamber 35 of flow control valve 31, and therefore the spool valve 33 moves toward its closed position by way of the bias of spring 34 to shut off the low-pressure refrigerant passage 25. As a result, the amount of refrigerant gas introduced into the refrigerant suction chamber 7 can be controlled to "0" to cause a decreased angle of the swash plate 15. The decreased swash-plate angle reduces the length of the piston stroke, thereby preventing the refrigerant gas pressure in the evaporator side of low-pressure refrigerant passage 25 from dropping, and thus preventing icing of the evaporator core. As discussed above, in the variable-displacement compressor of the embodiment, during the evaporator-deicing operating mode, only the supply of exciting current to the solenoid 42 is stopped. This effectively reduces electric power consumption. Additionally, the load of the compressor can be reduced to below almost zero by way of sliding movement of the spool valve 33 toward the fully-closed position by virtue of the spring bias. Thus it is possible to enhance the output of the driving source. Moreover, according to the variable-displacement compressor of the embodiment, when the spool valve 33 of flow control valve 31 is shifted to the fully-closed position by stopping the supply of exciting current to the solenoid 42, the pressure in refrigerant suction chamber 7 tends to drop and thus the differential pressure between the in-cylinder pressure (the refrigerant-suction-chamber pressure) and the crankcase pressure (the crank-chamber pressure) becomes maximum, and thus the swash-plate angle reduces by the moment of a force about the pin 17. As a result, the piston stroke becomes less and thus the work of compression of the compressor becomes almost zero. In this manner, the work of the compressor can be intermittently operated by energizing (magnetizing) or de-energizing (demagnetizing) the solenoid 42. Therefore, in the variable-displacement compressor of the embodiment, there is no necessity of a compressor clutch which engages or disengages to permit transmission of driving torque to the compressor shaft (drive shaft) or prevent transmission of driving torque to the compressor shaft. That is to say, there is no necessity for heavy magnets and electromagnetic coils required for an electromagnetic compressor clutch, for example. In other words, according to the fundamental concept of the invention, a clutchless swashplate type variable-displacement compressor can be realized by controlling energization (magnetization) and de-energization (demagnetization) of the solenoid 42 of flow control valve actuating mechanism 32. As a matter of course, the variable-displacement compressor of the embodiment is simple in structure. Also, there is no necessity of wiring harnesses for the electromagnetic clutch. This realizes a lightweight, clutchless swashplate type variable-displacement compressor. This means reduced production costs in manufacturing variable-displacement compressors. When rapidly accelerating or decelerating the vehicle under a condition that the ball valve (pilot valve) 41 is kept at a given opening by flowing exciting current of a predetermined current value across the solenoid 42 of flow control valve actuating mechanism 32, the drive shaft 10 tends to positively or negatively fluctuate owing to torque fluctuations arising from the vehicle acceleration or deceleration. Due to the fluctuations in rotation of the compressor drive shaft, the refrigerant gas pressure at the evaporator side of low-pressure refrigerant passage 25 upstream of the flow control valve 31 also tends to change. The pressure change in the pressure at the evaporator side can be sensed by the diaphragm of the feedback means 46 at once, and as a result the ball valve 41 is properly shifted to the valve opening direction or to the valve closing direction by means of the plunger 51 depending on the pressure change, and whereby the pressure at the evaporator side can be maintained at a predetermined pressure level substantially corresponding to the current value of exciting current flowing through the solenoid 42. Thus, it is possible to avoid a controlled temperature of the evaporator from undesiredly fluctuating owing to rapid vehicle acceleration or rapid vehicle deceleration. When the variable-displacement compressor with the feedback means is used for an automotive air conditioning system, there are less temperature fluctuations in conditioned air discharged from discharge outlets, and thus it is possible to provide stable air-conditioning operation. Additionally, in the variable-displacement compressor of the embodiment, the pressure-receiving surface area of the first side wall 36*a* of spool groove 36 of spool valve 33 is dimensioned to be equal to that of the second side wall 36*b* of spool groove 36. Therefore, it is unnecessary to sense the pressure difference between the pressure applied to the first side wall 36*a* and the pressure applied to the second side wall 36*b*. That is, it is possible to easily enhance the control accuracy of upstroke (upward sliding movement) or downstroke (downward sliding movement) of spool valve 33 by managing or controlling both the bias of spring 34 and the working pressure applied to the pressure chamber 35. This enables a high-accuracy flow control. Moreover, in variable-displacement compressor of the embodiment, the crank chamber 5 is communicated through the pressure regulating passage 52 with the evaporator side of low-pressure refrigerant passage 25 upstream of the flow control valve 31, so the pressure in crank chamber 5 is adjusted to and held at the same low-side pressure at the evaporator side. Thus, it is possible to enhance the variable-displacement control accuracy of the compressor, while reducing a gas pressure change occurring due to blow-by gases introduced into the crank chamber 5 to the minimum.

Figure 4:
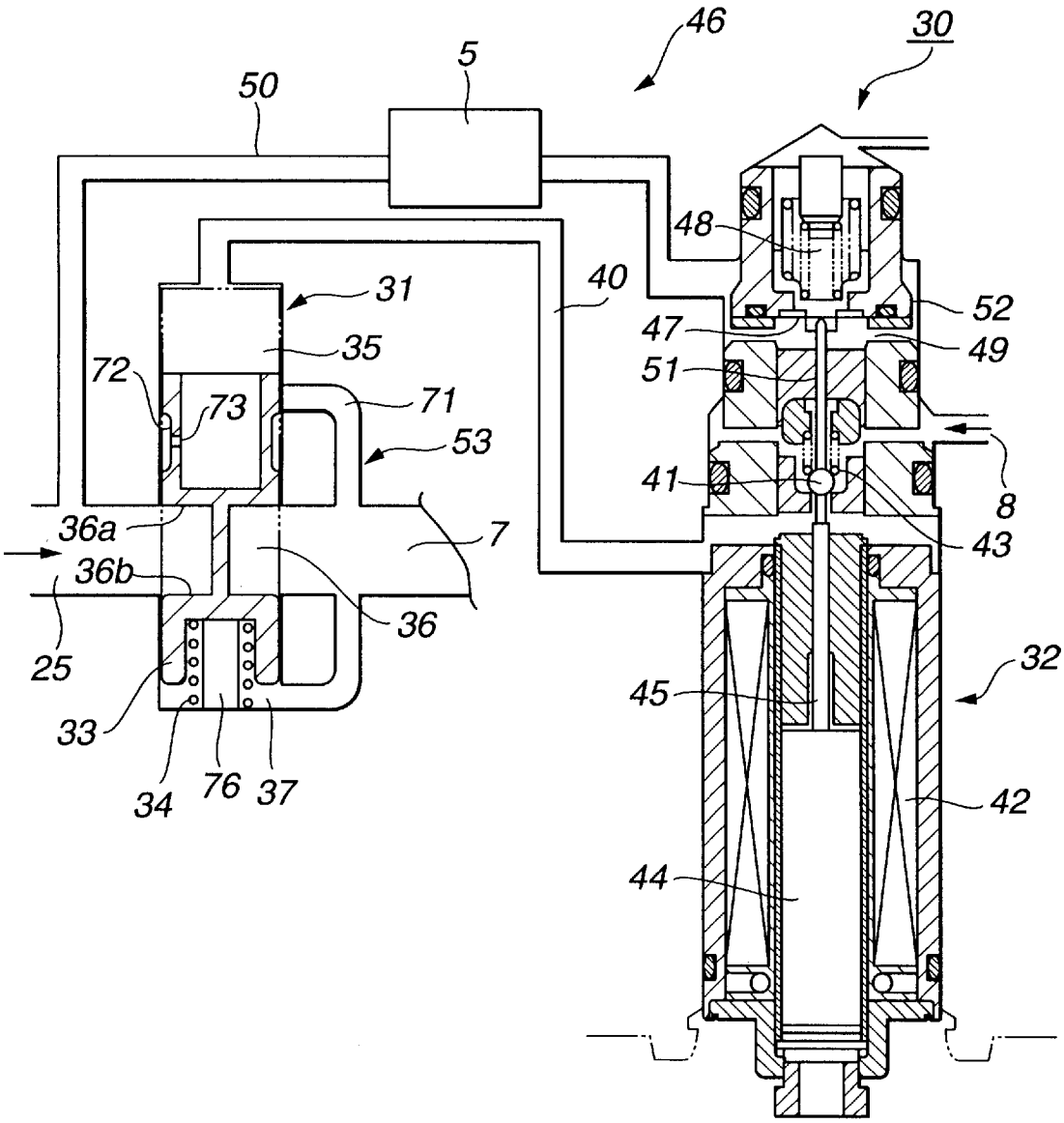
FIG. 4 is a cross-sectional view systematically showing a second embodiment of a pressure regulator means incorporated in the variable-displacement compressor shown in FIG. 1, with a flow-control spool valve kept in its fully-opened state.
Figure 5:
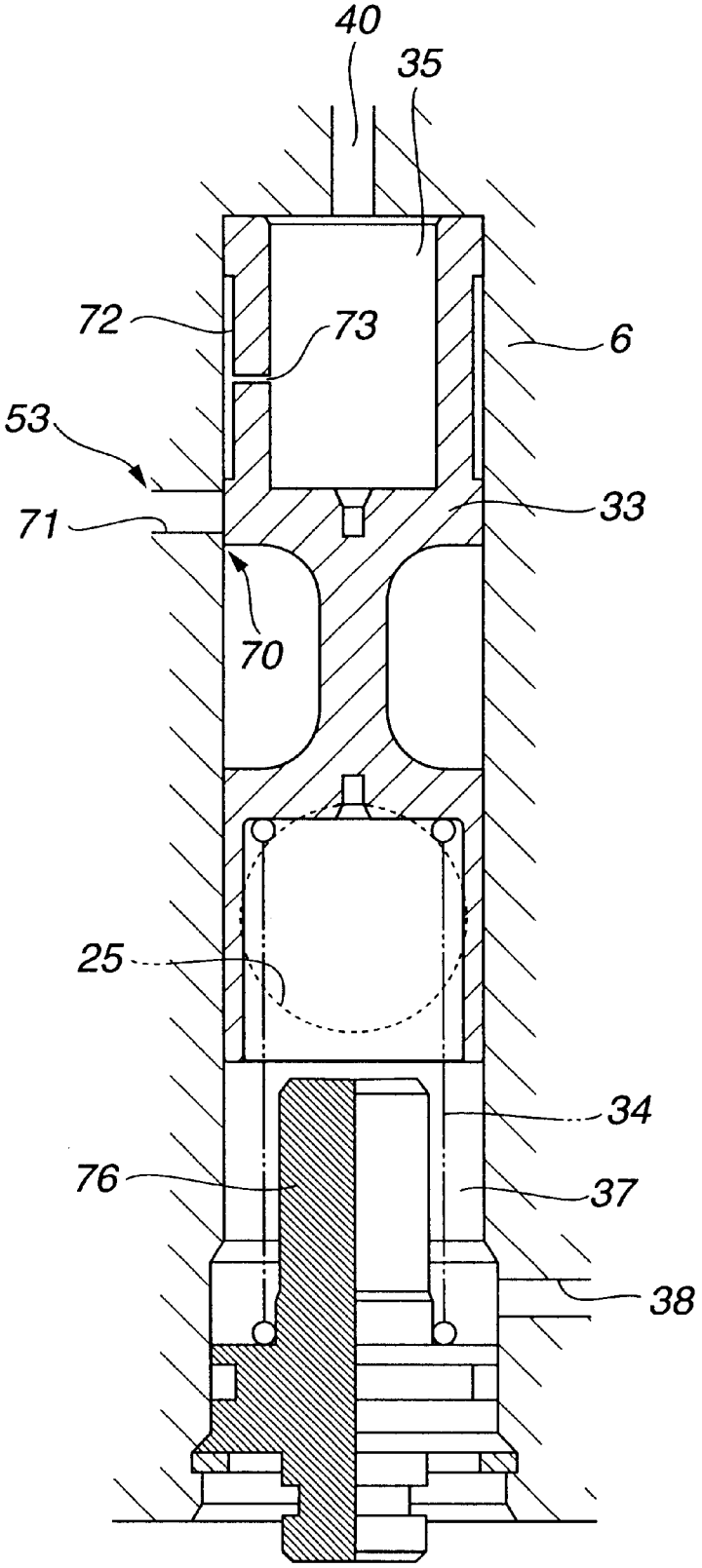
FIG. 5 is an enlarged cross sectional view showing the detailed structure of a flow control valve of the pressure regulator means sown in FIG. 4, with a flow-control spool valve kept in its fully-closed state.
Figure 6:
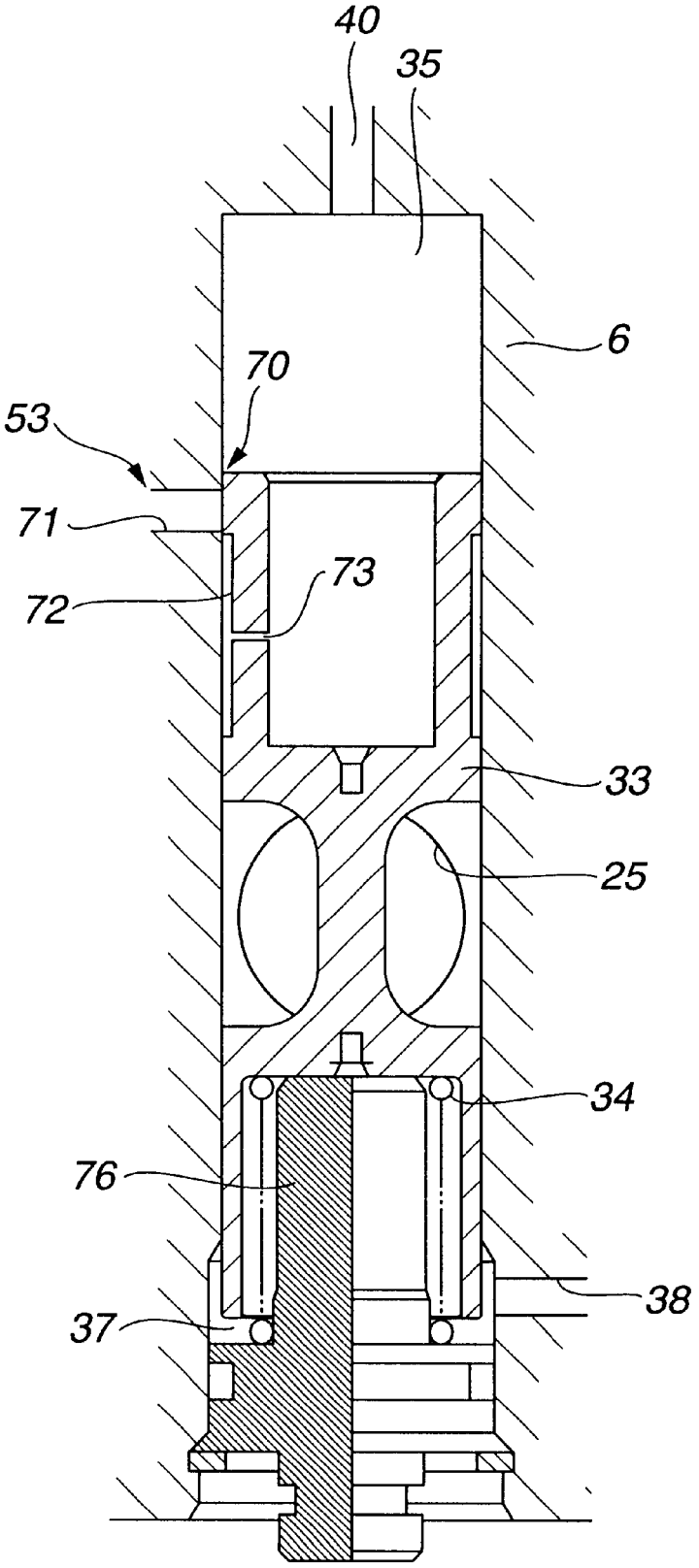
FIG. 6 is an enlarged cross sectional view showing the detailed structure of the flow control valve of the pressure regulator means shown in FIG. 4, with the flow-control spool valve kept in its fully-opened state.

Referring now to FIGS. 4 through 6, there are shown the longitudinal cross sections of the pressure regulating means 30 incorporated in the variable-displacement compressor of the second embodiment. The cross section of the pressure regulating means of FIGS. 4–6 is similar to that of FIGS. 2 and 3, except that the structure of the flow control valve 31 of the pressure regulating means 30 of the second embodiment is different than the first embodiment. Thus, the same reference signs used to designate elements of the pressure regulating means shown in FIGS. 2 and 3 will be applied to the corresponding elements of the second embodiment shown in FIGS. 4–6, for the purpose of comparison of the first and second embodiments. Elements 70, 71, 72, 73 and 76 will be hereinafter described in detail with reference to the accompanying drawings, while detailed description of the other elements will be omitted because the above description thereon seems to be self-explanatory. As shown in FIGS. 5 and 6, the flow control valve 31 of the pressure regulating means 30 of the compressor of the second embodiment includes a fluid-flow passage shutoff means 70 as well as the pressure regulating passage 53. As discussed above, the pressure regulating passage 53 serves to relieve the pressure in the pressure chamber 35 and to channel the pressure into the refrigerant suction chamber side of low-pressure refrigerant passage 25. The fluid-flow passage shutoff means 70 functions to fully close the pressure regulating passage 53 when the spool valve 33 is fully closed. In the flow control valve structure of the second embodiment, as can be appreciated from the cross sections shown in FIGS. 5 and 6, fluid-flow passage shutoff means 70 also functions to fully close the pressure regulating passage 53 when the spool valve 33 is fully opened (see FIG. 6) and when the spool valve 33 is fully closed (see FIG. 5). In more detail, as shown in FIGS. 4 through 6, a communication passage 71 is provided in the rear housing 6 which accommodates therein the spool valve 33, so that the communication passage 71 communicates the refrigerant suction chamber side of low-pressure refrigerant passage 25. The communication passage 71 is communicatable with the pressure chamber 35 depending on the axial position of the spool valve 33. A substantially annular recessed portion 72 is formed on the outer peripheral surface of the spool valve 33 in such a manner as to be communicatable with the opening end of the communication passage 71 facing the pressure chamber 35 depending on the axial position of the spool valve 33. To provide a desired orifice-constriction effect, an orifice passage 73 having a predetermined orifice size or a predetermined flow-constriction passage area is formed in the spool valve 33. The substantially annular recessed portion 72 communicates with the pressure chamber 35 via the orifice passage 73. In the second embodiment shown in FIGS. 4 through 6, the previously-noted pressure regulating passage 53 is comprised of the communication passage 71, the recessed portion 72, and the orifice passage 73. Recessed portion 72 is designed or formed on the outer periphery of the spool valve 33 so that the recessed portion is brought into fluid-communication with the opening end of communication passage 71 only when the spool valve 33 is held within a predetermined stroke range of axial spool-valve stroke, that is, within a predetermined valve opening range of the spool valve 33 except for both the fully-closed position and the fully-opened position. Thus, the spool valve 33 itself serves as the previously-noted fluid-flow passage shutoff means 70. A component part denoted by reference sign 76 corresponds to the spool-valve fully-opened-position limiting stopper 62 of flow control valve 31 of the first embodiment that limits the maximum downstroke (bottom dead center) of spool valve 33 by way of abutment between the lower end of the spool valve and the upper end face of the stopper. With the aforementioned arrangement of the second embodiment, when the solenoid 42 is energized, the opening of the ball valve 41 is controlled depending on the current value of exciting current flowing through the solenoid 42. As a result, high-pressure and high-temperature refrigerant gas in the refrigerant discharge chamber 8 flows through the ball valve 41 into the communication passage 40. The high-pressure, high-temperature refrigerant gas is thus introduced into the pressure chamber 35 as a working pressure for spool valve 33. In response to the pressure in the pressure chamber 35, the spool valve 33 moves toward its fully-opened position against the spring bias. The axial sliding movement of the spool valve 33 toward the fully-opened position tends to enlarge the fluid flow passage area of the low-pressure refrigerant passage 25 to control the flow of refrigerant flowing into the refrigerant suction chamber 7. By the controlled flow of low-pressure refrigerant gas, the differential pressure between the refrigerant-suction-chamber pressure and the crank-chamber pressure can be adjusted and thus the swash-plate inclination angle can be controlled. As a result of this, the length of the piston stroke can be varied to control the flow of refrigerant gas discharged for the purpose of temperature control of the evaporator (not shown). In the same manner as the first embodiment, in the pressure regulating means incorporated in the variable displacement compressor of the second embodiment, the flow control valve 31 includes the pressure regulating passage 53 through which the pressure in the pressure chamber 35 can be relieved and channeled into the refrigerant suction chamber side of low-pressure refrigerant passage 25. Thus, when the pilot valve (ball valve) 41 is closed by way of demagnetization of the solenoid 42 under a condition that the spool valve 33 is held at a given valve opening, the pressure regulating passage 53 serves to rapidly channel the working pressure in the pressure chamber 35 therethrough into the refrigerant suction chamber 7, thus ensuring a smooth valve closing operation for the spool valve 33 by virtue of the spring bias. This enhances a response of the compressor (a power unit of the air conditioning system), thus ensuring enhanced entire system response. In addition to the above, according to the variable-displacement compressor of the second embodiment, when the spool valve 33 is kept at the fully-closed position (see FIG. 5), the opening end of pressure regulating passage 53 facing the pressure chamber 35 is kept generally fully closed by means of the fluid-flow passage shutoff means 70. This enables a rapid rise in the pressure in the pressure chamber 35 when the pilot valve (ball valve) 41 is opened. Therefore, even during low load of the compressor, that is, even in an operating range in which the discharge pressure of refrigerant gas introduced into the pressure chamber 35 as a working pressure is relatively low, it is possible to rapidly rise the pressure in the pressure chamber 35, thereby ensuring initial sliding motion of the spool valve 33, and thus enhancing the spool-valve start-up performance (that is, the spool-valve opening performance). Furthermore, in the variable-displacement compressor of the second embodiment, even when the spool valve 33 is kept at the fully-opened position (see FIG. 6), the opening end of pressure regulating passage 53 facing the pressure chamber 35 is kept generally fully closed by means of the fluid-flow passage shutoff means 70. Therefore, even during high load of the compressor with the spool valve 33 fully opened, it is possible to prevent the high-pressure and high-temperature refrigerant gas introduced into the pressure chamber 35 from flowing via the pressure regulating passage 53 into the refrigerant suction chamber 7. This prevents a cooling performance of the refrigeration system from lowering during the high compressor load with the spool valve 33 fully opened. In particular, in the variable-displacement compressor of the second embodiment shown in FIGS. 4–6, depending upon the mutual setting between the position of the opening end of communication passage 71 facing the pressure chamber 35 and formed in the rear housing, and the axial machining range of the recessed portion 72 formed on the outer periphery of the spool valve 33, the spool valve 33 itself constructs the fluid-flow passage shutoff means 70. This effectively reduces the number of component parts, thus ensuring reduced production costs. Additionally, in the same manner as the first embodiment, in the variable-displacement compressor of the second embodiment, for the purpose of preventing icing of the evaporator core when the refrigeration system is operating, the current value of exciting current flowing through the solenoid 42 is simply controlled to "0", and thus the solenoid is merely demagnetized. Owing to demagnetization of solenoid 42, the ball valve (pilot valve) 41 is fully closed so as to stop the working-pressure supply to the pressure chamber 35, and therefore the spool valve 33 moves toward its closed position by way of the spring bias to shut off the low-pressure refrigerant passage 25. As a result, the amount of refrigerant gas introduced into the refrigerant suction chamber 7 can be controlled to "0" to cause a decreased angle of the swash plate 15. The decreased swash-plate angle reduces the length of the piston stroke, thereby preventing the pressure in the evaporator side of low-pressure refrigerant passage 25 from falling too low, and thus preventing icing of the evaporator. As discussed above, according to the variable-displacement compressor of the second embodiment, during the evaporator-deicing mode, only the supply of exciting current to the solenoid 42 is stopped. This effectively reduces electric power consumption. As appreciated from the above, the variable-displacement compressor of the second embodiment provides the same effects as the first embodiment.

Figure 7A:
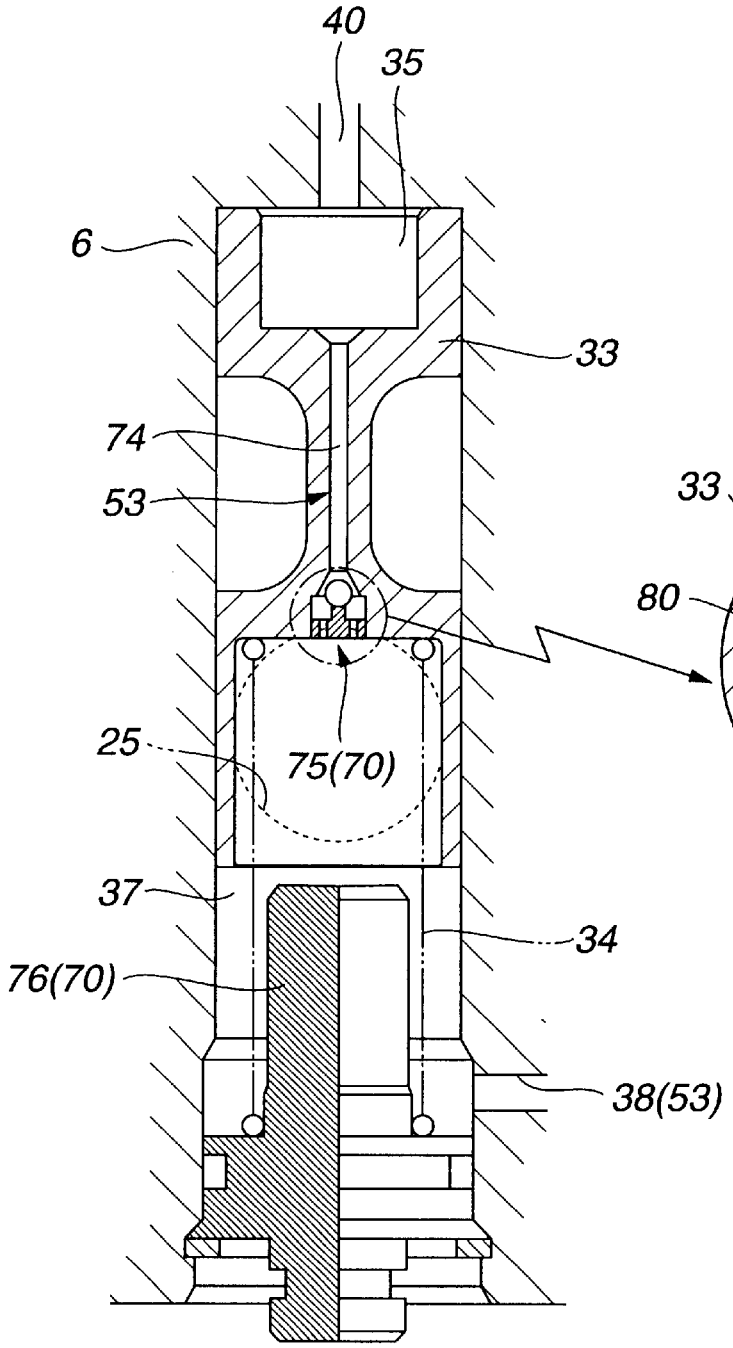
FIG. 7A is an enlarged cross sectional view showing the detailed structure of a modified flow control valve of the pressure regulator means shown in FIG. 4, with a flow-control spool valve kept in its fully-closed state.
Figure 7B:
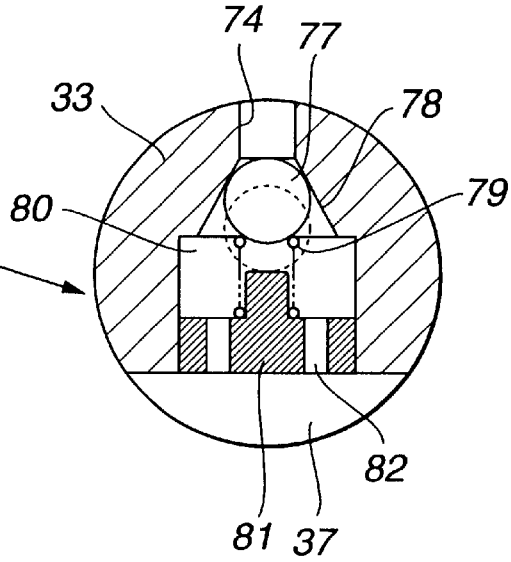
FIG. 7B is a partly-enlarged cross sectional view showing the detailed structure of a fluid-flow passage shutoff means of the modified flow control valve of the pressure regulator means shown in FIG. 4.
Figure 8:
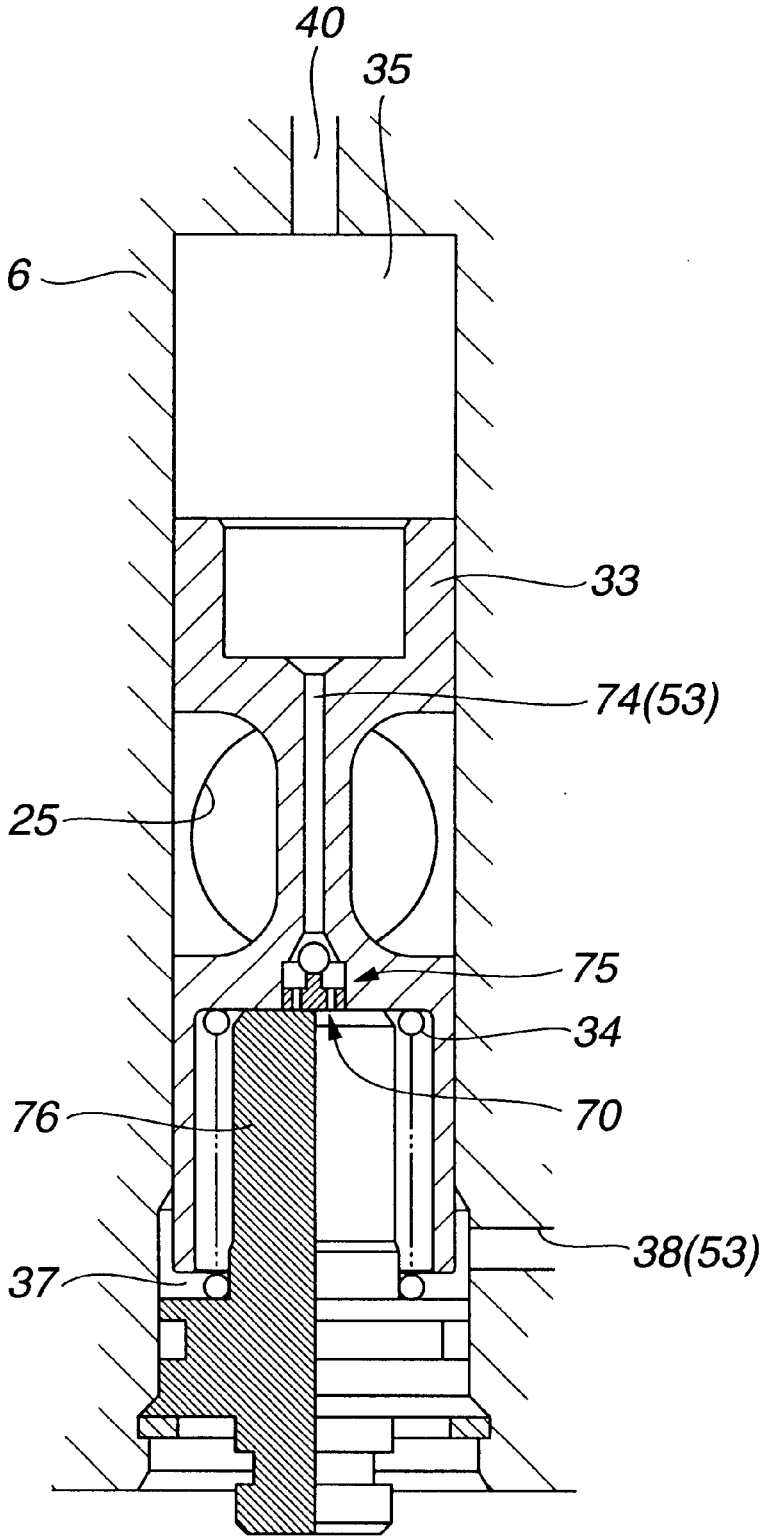
FIG. 8 is an enlarged cross sectional view showing the detailed structure of the modified flow control valve of the pressure regulator means shown in FIG. 4, with the flow-control spool valve kept in its fully-opened state.

Referring now to FIGS. 7A, 7B and 8, there are shown the longitudinal cross sections of the modified flow control valve of the pressure regulating means 30. The flow control valve 31 of FIGS. 7A, 7B and 8 is slightly different from that of FIGS. 4 through 6, in that in the modified flow control valve of FIGS. 7A, 7B and 8, the pressure regulating passage 53 is constructed by a flow-constriction passage 74 and the communication passage 38. Flow-constriction passage 74 is provided in the spool valve 33 in such a manner as to intercommunicate the pressure chamber 35 and the spring chamber 37 with orifice constriction. To-provide a desired orifice-constriction effect, flow-constriction passage 74 has a predetermined orifice size or a predetermined flow-constriction passage area. Spring chamber 37 is communicated through the communication passage 38 with the refrigerant suction chamber 7. Flow-constriction passage 74 is also communicated through a differential pressure valve 75 (which will be fully described later) via the communication passage 38 with the refrigerant suction chamber 7. As best seen in FIGS. 7A and 8, the flow-constriction passage 74 is provided in the spool valve 33 as an axial orifice passage formed along the axis of the spool valve 33. As shown in FIG. 8, when the spool valve 33 is held at its fully-opened position, the opening end (the lower end) of flow-constriction passage 74 facing the spring chamber 37 is closed by way of the upper end face of spool-valve fully-opened-position limiting stopper 76 disposed in the spring chamber 37. Conversely when the spool valve 33 is held at its fully-closed position (see FIG. 7A), the differential pressure valve 75, disposed in the flow-constriction passage 74, serves to fully close the flow-constriction passage 74 in response to the differential pressure between the pressure in the pressure chamber 35 and the pressure in the spring chamber 37. In the modified flow control valve shown in FIGS. 7A, 7B and 8, the fluid-flow passage shutoff means 70 is comprised of both the differential pressure valve 75 and the spool-valve fully-opened-position limiting stopper 76. In the embodiment shown in FIGS. 7A, 7B and 8, a large-diameter bore portion is formed in the lower opening end portion of flow-constriction passage 74 facing the spring chamber 37, and differential pressure valve 75 is provided in the large-diameter bore portion. As clearly shown in FIG. 7B, the differential pressure valve 75 is comprised of a ball valve 77, a return spring 79, and a spring seat 81. Ball valve 77 is normally seated on a tapered valve seat 78 formed at the lower end of flow-constriction passage 74 by way of the bias of the spring 79. The spring 79 forces the ball valve 77 toward the tapered valve seat 78. Spring seat 81 is fixedly connected and fitted into the previously-noted large-diameter bore portion so as to define a valve chamber 80 and to support the lower end of spring 79. Spring seat 81 has a plurality of axial through holes 82 through which the valve chamber 80 is communicated with the spring chamber 37. As can be seen from the cross section of FIG. 8, when the spool valve 33 is held at the fully-opened position, all of the through holes 82 are closed by way of the upper end face of spool-valve fully-opened-position limiting stopper 76. The spring bias of spring 79 is preset to quickly open the ball valve 77 when the working pressure is introduced into the pressure chamber 35 with the pilot valve 41 opened and thus the differential pressure between the pressure in the pressure chamber 35 and the pressure in the spring chamber 37 exceeds a predetermined differential-pressure threshold. With the previously-described arrangement of the embodiment shown in FIGS. 7A, 7B and 8, the variable-displacement compressor having the valve structure shown in FIGS. 7A, 7B and 8 can provide the same effects as that shown in FIGS. 4 through 6. In addition, the pressure regulating passage 53 is constructed by both the flow-constriction passage 74 which is provided in the spool valve 33 itself, and the communication passage 38 through which the spring chamber 37 is opened into the refrigerant suction chamber 7 and which is used for balanced operation of the spool valve 33. Thus, the number of machining processes for boring fluid passages in the rear housing 6 can be reduced. This ensures a more simplified passage structure in the rear housing, and also increases the design flexibility of the rear housing. Furthermore, the shutting-off operation of the pressure regulating passage 53 executed when the spool valve 33 is fully closed or fully opened can be achieved by both the differential pressure valve 75 and the spool-valve fully-opened-position limiting stopper 76. Thus, the fluid-flow passage shutoff means 70 is very simple in structure.

Figure 9:
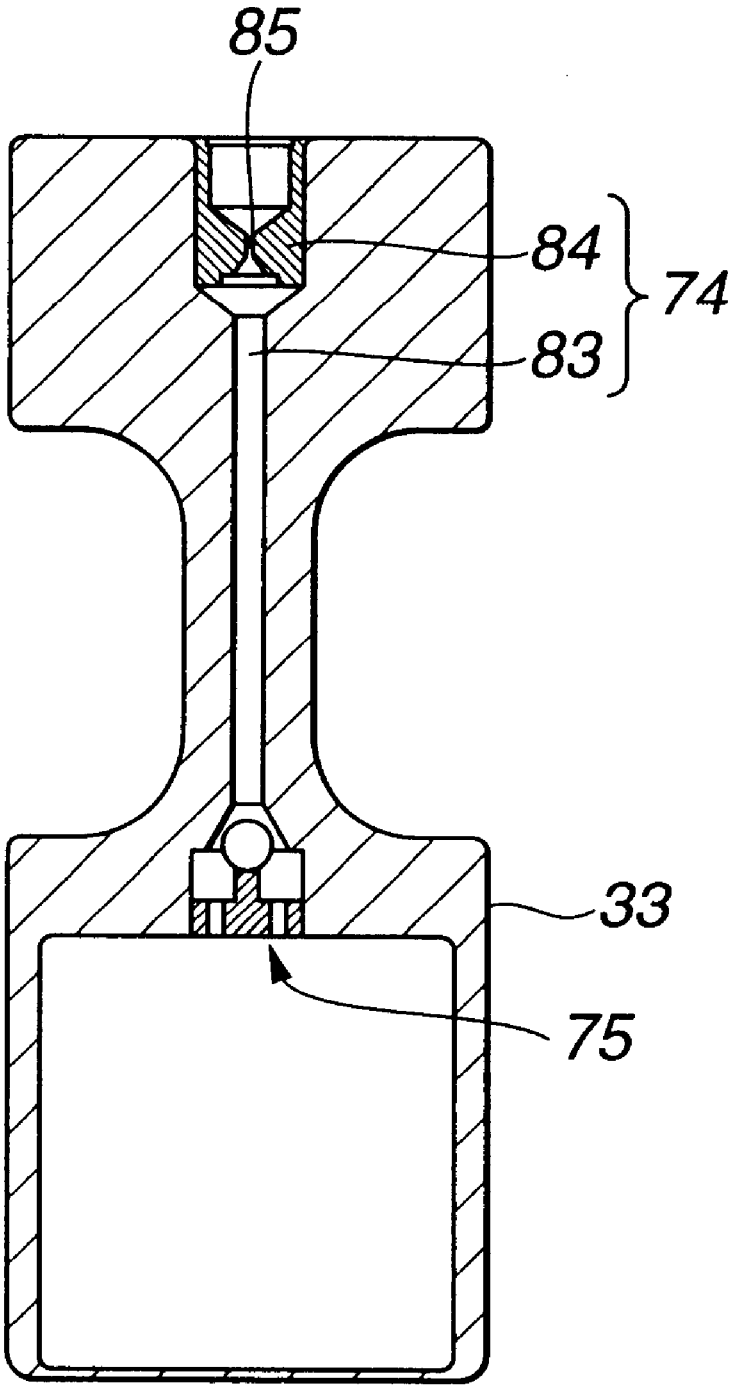
FIG. 9 is an enlarged cross sectional view showing the detailed structure of a spool,valve of a further modified flow control valve of the pressure regulator means shown in FIG. 4.

Referring now to FIG. 9, there is shown the longitudinal cross section of another modified flow control valve structure of the pressure regulating means 30. The flow control valve structure of FIG. 9 is slightly different from that of FIGS. 7A, 7B and 8, as described hereunder.

In the flow control valve:structure of FIGS. 7A, 7B and 8, the flow-constriction passage 74 having the predetermined flow-constriction orifice passage area is formed in the spool valve 33. On the other hand, in the flow control valve structure of FIG. 9, a communication passage 83 is provided in the spool valve 33 as an axial passage formed along the axis of the spool valve 33 and intercommunicating the pressure chamber 35 and the spring chamber 37. A large-diameter bore portion is formed in the upper opening end portion of communication passage 83 facing the pressure chamber 35. A bushing 84 has an orifice passage 85. Bushing 84 is fitted into the large-diameter bore portion formed in the upper opening end portion of communication passage 83. That is to say, the flow-constriction passage 74 is constructed by the axial communication passage 83 and the bushing 84 having the orifice passage 85 of the predetermined orifice size. In the flow control valve structure shown in FIGS. 7A, 7B and 8, to provide a predetermined orifice-constriction effect, the flow-constriction passage 74 of a relatively small orifice size has to be finely formed or bored directly in the spool valve 33. In comparison with the flow-constriction orifice passage 74 of the flow control valve structure shown in FIGS. 7A, 7B and 8, the bore size of the communication passage 83 of the flow control valve structure of FIG. 9 is comparatively large, thus facilitating machining of the axial bore formed in the spool valve 33. Additionally, the predetermined orifice-constriction effect can be easily obtained only by fitting the bushing 84 having the fixed orifice 85 of the predetermined orifice size into the large-diameter bore portion of the spool valve, thus enhancing the productivity of the variable-displacement compressor.

In both the flow control valve structure shown in FIGS. 7A, 7B and 8 and the flow control valve structure shown in FIG. 9, the differential pressure valve 75 is provided at one opening end of flow-constriction passage 74 facing the spring chamber 37. In lieu thereof, the differential pressure valve may be provided at the other opening end of flow-constriction passage 74 facing the pressure chamber 35. In this case, the bushing 84 of the flow control valve structure shown in FIG. 9 has to be provided at the opening end of flow-constriction passage 74 facing the spring chamber 37.

The entire contents of Japanese Patent Application No. P2000-040907 (filed Feb. 18, 2000) and P2000-040918 (filed Feb. 18, 2000) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A swashplate type variable-displacement compressor comprising;

a compressor housing which defines therein a crank chamber, a refrigerant suction chamber, a refrigerant discharge chamber, and a low-pressure refrigerant passage connected to an evaporator outlet;

a pressure regulator which controls an amount of refrigerant gas flowing into the refrigerant suction chamber by regulating a differential pressure between a pressure in the refrigerant suction chamber and a pressure in the crank chamber, the pressure regulator comprising:

(a) a flow control valve including a spring-loaded, normally-closed spool valve, a return spring permanently biasing the spool valve to a fully-closed position, a spring chamber operably accommodating therein the return spring, and a pressure chamber accumulating a working pressure used to force the spool valve toward a fully-opened position, the flow control valve provided in the low-pressure refrigerant passage upstream of the refrigerant suction chamber; and (b) a flow control valve actuating mechanism including a communication passage through which the refrigerant discharge chamber communicates with the pressure chamber, a second spring-loaded, normally-closed pilot valve provided in the communication passage, a return spring permanently biasing the pilot valve to a fully-closed position, and an electromagnetic solenoid controlling an opening of the pilot valve so that the opening increases with an increase in exciting current supplied to the solenoid, the pilot valve serving to introduce high-pressure refrigerant gas in the refrigerant discharge chamber into the pressure chamber as the working pressure with the opening controlled by the solenoid; and the flow control valve including a pressure regulating passage which channels the working pressure in the pressure chamber into the refrigerant suction chamber, and a flow-constriction means which serves to generally fully close the pressure regulating passage when the spool valve is held at the fully-opened position.

2. The swashplate type variable-displacement compressor as claimed in claim 1, wherein the pressure regulating passage comprises a communication passage through which the spring chamber of the flow control valve communicates with the refrigerant suction chamber, and a flow-constriction passage formed in the spool valve to intercommunicate the pressure chamber and the spring chamber, and which further comprises a stopper provided in the spring chamber to limit the fully-opened position of the spool valve and to close an opening end of the flow-constriction passage facing the spring chamber by abutment between the spool valve and an end face of the stopper when the spool valve is held at the fully-opened position, and wherein the flow-constriction means comprises a flow-constriction orifice groove formed on at least one of the end face of the stopper and the opening end of the flow-constriction passage facing the spring chamber to provide a flow-constriction orifice having a predetermined orifice size smaller than a flow-constriction passage area of the flow-constriction passage under a condition in which the fully-opened position of the spool valve is limited by abutment between the spool valve and the end face of the stopper.

3. The swashplate type variable-displacement compressor as claimed in claim 1, wherein the spool valve comprises a spool groove, and a pressure-receiving surface area of one side wall of the spool groove is dimensioned to be equal to a pressure-receiving surface area of the other side wall of the spool groove.

4. The swashplate type variable-displacement compressor as claimed in claim 1, wherein the flow control valve actuating mechanism further comprises a feedback means which detects a change in pressure in the evaporator outlet side of the low-pressure refrigerant passage upstream of the flow control valve to shift the pilot valve to either of a valve opening direction and a valve closing direction depending on the pressure change detected when the pressure change in the evaporator outlet side of the low-pressure refrigerant passage exceeds a predetermined allowable pressure change under a condition that the pilot valve is held at a given opening, so that an opening of the flow control valve is controlled and thus the pressure in the evaporator outlet side is kept constant.

5. The swashplate type variable-displacement compressor as claimed in claim 1, wherein the flow control valve actuating mechanism further comprises a pressure regulating passage through which the crank chamber communicates with the evaporator outlet side of the low-pressure refrigerant passage upstream of the flow control valve.

6. A swashplate type variable-displacement compressor comprising:

a compressor housing which defines therein a crank chamber, a refrigerant suction chamber, a refrigerant discharge chamber, and a low-pressure refrigerant passage connected to an evaporator outlet;

a pressure regulator which controls an amount of refrigerant gas flowing into the refrigerant suction chamber by regulating a differential pressure between a pressure in the refrigerant suction chamber and a pressure in the crank chamber, the pressure regulator comprising:

(a) a flow control valve including a spring-loaded, normally-closed spool valve, a return spring permanently biasing the spool valve to a fully-closed position, a spring chamber operably accommodating therein the return spring, and a pressure chamber accumulating a working pressure used to force the first valve toward a fully-opened position, the flow control valve provided in the low-pressure refrigerant passage upstream of the refrigerant suction chamber; and (b) a flow. control valve actuating mechanism including a communication passage through which the refrigerant discharge chamber communicates with the pressure chamber, a second spring-loaded, normally-closed pilot valve provided in the communication passage, a return spring permanently biasing the pilot valve to a fully-closed position, and an electromagnetic solenoid controlling an opening of the pilot valve so that the opening increases with an increase in exciting current supplied to the solenoid, the pilot valve serving to introduce high-pressure refrigerant gas in the refrigerant discharge chamber into the pressure chamber as the working pressure with the opening controlled by the solenoid; and the flow control valve including a pressure regulating passage which channels the working pressure in the pressure chamber into the refrigerant suction chamber, and a fluid-flow passage shutoff means which serves to fully close the pressure regulating passage when the spool valve is held at the fully-closed position.

7. The swashplate type variable-displacement compressor as claimed in claim 6, wherein the fluid-flow passage shutoff means serves to fully close the pressure regulating passage when the spool valve is held at the fully-opened position.

8. The swashplate type variable-displacement compressor as claimed in claim 6, wherein the pressure regulating passage comprises a communication passage formed in the housing accommodating therein the spool valve to communicate the pressure chamber with the refrigerant suction chamber there via, a recessed portion formed on an outer periphery of the spool valve which is communicatable with an opening end of the communication passage facing the pressure chamber depending on an axial position of the spool valve, and an orifice passage formed in the spool valve to communicate the recessed portion with the pressure chamber there via, and the recessed portion is formed on the outer periphery of the spool valve so that the recessed portion is brought into fluid-communication with the opening end of the communication passage facing the pressure chamber only when the spool valve is held within a predetermined valve opening range of the spool valve except for both the fully-closed position and the fully-opened position, so as to form the fluid-flow passage shutoff means by the spool valve itself.

9. The swashplate type variable-displacement compressor as claimed in claim 6, wherein the pressure regulating passage comprises a communication passage through which the spring chamber of the flow control valve communicates with the refrigerant suction chamber, and a flow-constriction passage formed in the spool valve to intercommunicate the pressure chamber and the spring chamber.

10. The swashplate type variable-displacement compressor as claimed in claim 9, wherein the fluid-flow passage shutoff means serves to fully close the pressure regulating passage when the spool valve is held at the fully-opened position.

11. The swashplate type variable-displacement compressor as claimed in claim 10, wherein the fluid-flow passage shutoff means comprises a differential pressure valve provided in the flow-constriction passage to fully close the flow-constriction passage in response to a differential pressure between the pressure chamber and the spring chamber when the spool valve is held at the fully-closed position, and a stopper provided in the spring chamber to limit the fully-opened position of the spool valve and to close an opening end of the flow-constriction passage facing the spring chamber by abutment between the spool valve and the end face of the stopper when the spool valve is held at the fully-opened position.

12. The swashplate type variable-displacement compressor as claimed in claim 11, wherein the flow-constriction passage comprises a communication passage provided in the spool valve to intercommunicate the pressure chamber and the spring chamber, and a bushing fitted to one opening end of the communication passage and having an orifice passage.

13. The swashplate type variable-displacement compressor as claimed in claim 6, wherein the spool valve comprises a spool grove, and a pressure-receiving surface area of one side wall of the spool groove is dimensioned to be equal to a pressure-receiving surface area of the other side wall of the spool groove.

14. The swashplate type variable-displacement compressor as claimed in claim 6, wherein the flow control valve actuating mechanism further comprises a feedback means which detects a change in pressure in the evaporator outlet side of the low-pressure refrigerant passage upstream of the flow control valve to shift the pilot valve to either of a valve opening direction and a valve closing direction depending on the pressure change detected when the pressure change in the evaporator outlet side of the low-pressure refrigerant passage exceeds a predetermined allowable pressure change under a condition that the pilot valve is held at a given opening, so that an opening of the flow control valve is controlled and thus the pressure in the evaporator outlet side is kept constant.

15. The swashplate type variable-displacement compressor as claimed in claim 6, wherein the flow control valve actuating mechanism further comprises a pressure regulating passage through which the crank chamber communicates with the evaporator outlet side of the low-pressure refrigerant passage upstream of the flow control valve.

* * * * *